US010527041B2

(12) United States Patent
Moon et al.

(10) Patent No.: US 10,527,041 B2
(45) Date of Patent: Jan. 7, 2020

(54) COMPRESSOR HAVING OIL RECOVERY MEANS

(71) Applicant: Hanon Systems, Daejeon (KR)

(72) Inventors: Chi Myeong Moon, Daejeon (KR); Kweon Soo Lim, Daejeon (KR); Jae Hoon Lim, Daejeon (KR); Soo Cheol Jeong, Daejeon (KR)

(73) Assignee: Hanon Systems, Daejeon (KR)

( * ) Notice: Subject to any disclaimer, the term of this patent is extended or adjusted under 35 U.S.C. 154(b) by 18 days.

(21) Appl. No.: 15/527,983

(22) PCT Filed: Aug. 27, 2015

(86) PCT No.: PCT/KR2015/009000

§ 371 (c)(1),
(2) Date: May 18, 2017

(87) PCT Pub. No.: WO2016/190490

PCT Pub. Date: Dec. 1, 2016

(65) Prior Publication Data

US 2018/0347568 A1 Dec. 6, 2018

(30) Foreign Application Priority Data

May 26, 2015 (KR) ..... 10-2015-0073005

(51) Int. Cl.
*F04C 29/02* (2006.01)
*F04C 18/02* (2006.01)

(52) U.S. Cl.
CPC ..... *F04C 29/028* (2013.01); *F04C 18/0215* (2013.01); *F04C 18/0246* (2013.01); *F04C 2210/26* (2013.01); *F04C 2240/10* (2013.01)

(58) Field of Classification Search
CPC ..... F04C 29/02; F04C 29/026; F04C 29/028; F04C 18/0261; F04C 18/0248
See application file for complete search history.

(56) References Cited

U.S. PATENT DOCUMENTS 4,332,535 A * 6/1982 Terauchi ..... F04C 18/0215 418/55.6
4,506,423 A * 3/1985 Nakamura ..... B21D 26/14 138/149

(Continued)

FOREIGN PATENT DOCUMENTS

JP 2002168183 A 6/2002
JP 2002213380 A 7/2002

(Continued)

OTHER PUBLICATIONS

International Search Report issued in PCT/KR2015/009000 dated Feb. 5, 2016.

*Primary Examiner* — Deming Wan

(74) *Attorney, Agent, or Firm* — Norton Rose Fulbright US LLP

(57) ABSTRACT

Disclosed herein is a compressor with an oil return unit. The compressor includes: a main housing; a turning scroll which is turnably mounted to the housing; a fixed scroll which engages with the turning scroll and forms a compression chamber; an auxiliary housing which includes a discharge space communicating with an outlet side of the fixed scroll, and a collection space in which oil collected in the discharge space is temporarily stored; an oil return passage which is formed in the fixed scroll and communicates with the collection space; and an oil supply passage which is formed in the main housing, communicates with the oil return passage, and diverges such that oil is supplied to at least two places.

18 Claims, 5 Drawing Sheets

(56) References Cited

U.S. PATENT DOCUMENTS

| | | | | | |
|---|---|---|---|---|---|
| 5,624,243 | A * | 4/1997 | Omodaka | F04C 18/023 | 417/366 |
| 6,129,532 | A * | 10/2000 | Kato | F04B 27/109 | 417/269 |
| 9,181,951 | B2 * | 11/2015 | Tozawa | F04C 28/22 | |
| 2002/0094294 | A1 * | 7/2002 | Sekiguchi | F04C 29/026 | 418/259 |
| 2014/0023542 | A1 * | 1/2014 | Yamashita | F04C 29/026 | 418/55.6 |

FOREIGN PATENT DOCUMENTS

| | | | |
|---|---|---|---|
| JP | 2004360607 | A | 12/2004 |
| JP | 2007032511 | A | 2/2007 |
| JP | 2010163877 | A | 7/2010 |
| JP | 2013177826 | A | 9/2013 |
| JP | 2013204457 | A | 10/2013 |
| JP | 2013234666 | A | 11/2013 |
| KR | 20110006181 | A | 1/2011 |

* cited by examiner

COMPRESSOR HAVING OIL RECOVERY MEANS

This application is a § 371 of International Application No. PCT/KR2015/009000 filed Aug. 27, 2015 and claims priority from Korean Patent Application No. 10-2015-0073005 filed May 26, 2015.

TECHNICAL FIELD

Exemplary embodiments of the present invention relate to a compressor with an oil return unit, and more particularly, to a compressor having a unit for returning oil mixed with refrigerant to be discharged out of the compressor, to an internal space of the compressor.

BACKGROUND ART

Generally, air conditioning (A/C) apparatuses for cooling or heating passenger compartments are installed in vehicles. Such an air conditioning apparatus includes, as a configuration for a cooling system, a compressor, which compresses low-temperature and low-pressure gaseous refrigerant drawn from an evaporator into a high-temperature and high-pressure gaseous state, and transfers it to a condenser.

Compressors are classified into a reciprocating compressor which compresses refrigerant using reciprocating motion of a piston, and a rotary compressor which performs rotational motion to compress refrigerant. According to a drive force transmission method, reciprocating compressors are classified into a crank type in which drive force is transmitted by a plurality of piston using a crank, a swash plate type in which drive force is transmitted by a rotating shaft provided with a swash plate, and so forth. Rotary compressors are classified into a vane rotary type which employs a rotary shaft and vane, and a scroll type which employs a turning scroll and a fixed scroll.

In compressors, as a compression unit is driven by rotating a rotor, refrigerant is compressed. In this regard, since movable parts of the compression unit including a rotating part such as the rotor repeatedly make friction with stationary parts, lubrication is necessarily required. Particularly, in the case of the scroll compressor, lubrication between the fixed scroll and the turning scroll is very important. To minimize power loss and prevent damage due to abrasion, friction between the fixed scroll and the turning scroll must be minimized, but to enhance compression efficiency, leakage of refrigerant between the fixed scroll and the turning scroll must also be minimized.

For this, hitherto, a method in which oil is mixed with refrigerant to lubricate mechanical friction portions in a compression chamber has been used. This method is efficient because an oil supply structure can be simplified, but is problematic in that some oil mixed with refrigerant is discharged out of the compressor and thus the amount of oil is reduced.

To overcome the foregoing problem, an oil separator is used along with the compressor. For a certain shape, the oil separator may be separately provided from the compressor. However, in the case of, e.g., a vehicle which cannot provide sufficient installation space, the oil separator may be integrally formed in a compressor housing. Typically, such an oil separator collects oil from refrigerant while colliding with the refrigerant discharged out of the compressor, and returns the collected oil to the compressor. When oil returned in this way is supplied into the compressor, oil must be supplied at an appropriate flow rate to desired parts of the compressor. However, due to this, there is a problem in that an oil supply passage is complex. Therefore, a method capable of efficiently supplying returned oil despite having a simple oil supply passage is required.

DISCLOSURE

Technical Problem

An embodiment of the present invention relates to a compressor with an oil return unit capable of efficiently supplying returned oil into a compressor housing.

Technical Solution

A compressor with an oil return unit in accordance with a first embodiment of the present invention may include: a main housing; a turning scroll turnably mounted to the housing; a fixed scroll engaging with the turning scroll and forming a compression chamber; an auxiliary housing including a discharge space communicating with an outlet side of the fixed scroll, and a collection space in which oil collected in the discharge space is temporarily stored; an oil return passage formed in the fixed scroll and communicating with the collection space; and an oil supply passage formed in the main housing and communicating with the oil return passage, the oil supply passage being formed to diverge such that oil is supplied to at least two places.

In the compressor in accordance with the first embodiment of the present invention, a single oil passage may be formed in the fixed scroll, and another oil passage communicating with the above-mentioned oil passage may be formed in another component, e.g., the main housing, which is disposed to be parallel with the fixed scroll, wherein oil may be supplied to a plurality of places.

The main housing may have a suction space in which a rotating shaft is housed, and the oil supply passage may include a first oil supply passage communicating with the suction space.

A back pressure chamber may be formed between a rear surface of the turning scroll and a facing surface of the main housing, and the oil supply passage may include a second oil supply passage communicating with the back pressure chamber.

A pressure reducing unit may be provided in the oil return passage.

An installation space may be formed in the oil return passage so that the pressure reducing unit is disposed in the installation space, wherein the inner diameter of the installation space may be greater than that of an inlet of the oil return passage.

A refrigerant pressure at an outlet side of the first oil supply passage may be lower than a refrigerant pressure at an outlet side of the second oil supply passage.

A pressure reducing unit may be provided in the first oil supply passage.

An installation space may be formed in the first oil supply passage so that the pressure reducing unit is disposed in the installation space, wherein the inner diameter of the installation space may be greater than that of an outlet of the first oil supply passage.

The first and second oil supply passages may have a common inlet communicating with an outlet of the oil return passage.

A sealing unit for sealing the back pressure chamber may be provided between the turning scroll and the main housing, and the common inlet may be disposed outside the sealing unit with respect to a radial direction.

The pressure reducing unit may include an oil transfer member with an oil transfer groove formed in an outer circumferential surface of the oil transfer member. The oil transfer groove may spirally extend in a longitudinal direction of the oil transfer member.

The oil transfer member may have a hydraulic space therein, and a communication hole communicating with the hydraulic space may be formed in an end of the oil transfer member.

Furthermore, the pressure reducing unit may further include a cover fitted over an outer circumferential surface of the oil transfer member.

The pressure reducing unit may include an oil transfer member in which an oil transfer hole that spirally extends in the longitudinal direction is formed.

The oil transfer member may have a hydraulic space therein, and a communication hole communicating with the hydraulic space may be formed in an end of the oil transfer member.

The pressure reducing unit may include: an oil transfer member; and a cover fitted over an outer circumferential surface of the oil transfer member, with an oil transfer groove formed in an inner surface of the cover, the oil transfer groove spirally extending in a longitudinal direction of the cover.

A sealing unit for preventing leakage of refrigerant between the fixed scroll and the main housing may be interposed between the fixed scroll and the main housing, and a through hole for communicating the oil return passage and the first oil supply passage with each other may be formed in the sealing unit.

The pressure reducing unit may be formed of material having a stiffness lower than that of the fixed scroll or the main housing.

A compressor with an oil return unit in accordance with a first embodiment of the present invention may include: a main housing including a suction space in which a rotating shaft is housed; a turning scroll turnably mounted to the housing; a fixed scroll engaging with the turning scroll and forming a compression chamber; an auxiliary housing including a discharge space communicating with an outlet side of the fixed scroll, and a collection space in which oil collected in the discharge space is temporarily stored; a back pressure chamber formed in the main housing and applied with a pressure compressing the turning scroll to the fixed scroll; an oil return passage formed in the fixed scroll and communicating with the collection space, with a pressure reducing unit provided in the oil return passage; a first oil supply passage formed in the main housing and extending between the oil return passage and the suction space; pressure reducing units respectively provided in the oil return passage and the first oil supply passage; and a second oil supply passage diverging between the two pressure reducing units and communicating with the back pressure chamber.

The second oil supply passage may include an inlet formed in an end of the main housing.

A sealing unit for sealing the back pressure chamber may be provided between the turning scroll and the main housing, and the inlet may be disposed outside the sealing unit with respect to a radial direction.

An installation space may be formed in at least one of the oil return passage and the first oil supply passage so that the pressure reducing unit is disposed in the installation space, wherein a stepped portion may be formed on an end of the installation space.

The stepped portion may block movement of the pressure reducing unit so that the pressure reducing unit is disposed at a correct position.

A sealing unit for preventing leakage of refrigerant between the fixed scroll and the main housing may be interposed between the fixed scroll and the main housing, and a through hole may be formed in the sealing unit so that the oil return passage and the first oil supply passage communicate with each other through the through hole.

Furthermore, the pressure reducing unit may include an oil transfer member having an oil transfer groove that forms an oil transfer passage along with an inner surface of the main housing or the fixed scroll.

The oil transfer member may be configured such that some oil is drawn thereinto, and the oil transfer member is expanded toward the inner surface of the main housing or the fixed scroll by the pressure of the drawn oil.

The oil transfer member may be formed of material having a stiffness lower than that of the fixed scroll or the main housing Furthermore, the pressure reducing unit may further include a cover fitted over an outer circumferential surface of the oil transfer member.

The pressure reducing unit may include an oil transfer member in which an oil transfer hole that spirally extends in the longitudinal direction is formed.

The pressure reducing unit may include: an oil transfer member; and a cover fitted over an outer circumferential surface of the oil transfer member, with an oil transfer groove formed in an inner surface of the cover, the oil transfer groove spirally extending in a longitudinal direction of the cover.

Advantageous Effects

In an embodiment of the present invention having the above-mentioned configuration, a single return passage is formed in a fixed scroll, and a plurality of supply passage are formed in a main housing. Therefore, an oil supply passage can be simplified.

Furthermore, oil can be independently supplied to a back pressure chamber and a suction space by the plurality of supply passages, so that efficient oil supply is possible. Particularly, the present invention includes an oil supply passage that directly communicates with the back pressure chamber, thus making it possible to enhance lubrication performance in the back pressure chamber, compared to that of the conventional art in which oil is indirectly supplied to the back pressure chamber.

In addition, an additional pressure reducing unit is provided in the suction space, whereby oil can be supplied to a plurality of spaces having different pressures.

Moreover, the pressure reducing unit may include an oil transfer member or a cover. In this case, oil supply efficiency can be prevented from deteriorating due to damage to an oil transfer passage during a product assembly process.

MODE FOR INVENTION

Hereinafter, embodiments of a compressor with an oil return unit in accordance with the present invention will be described in detail with reference to the attached drawings.

Figure 1:
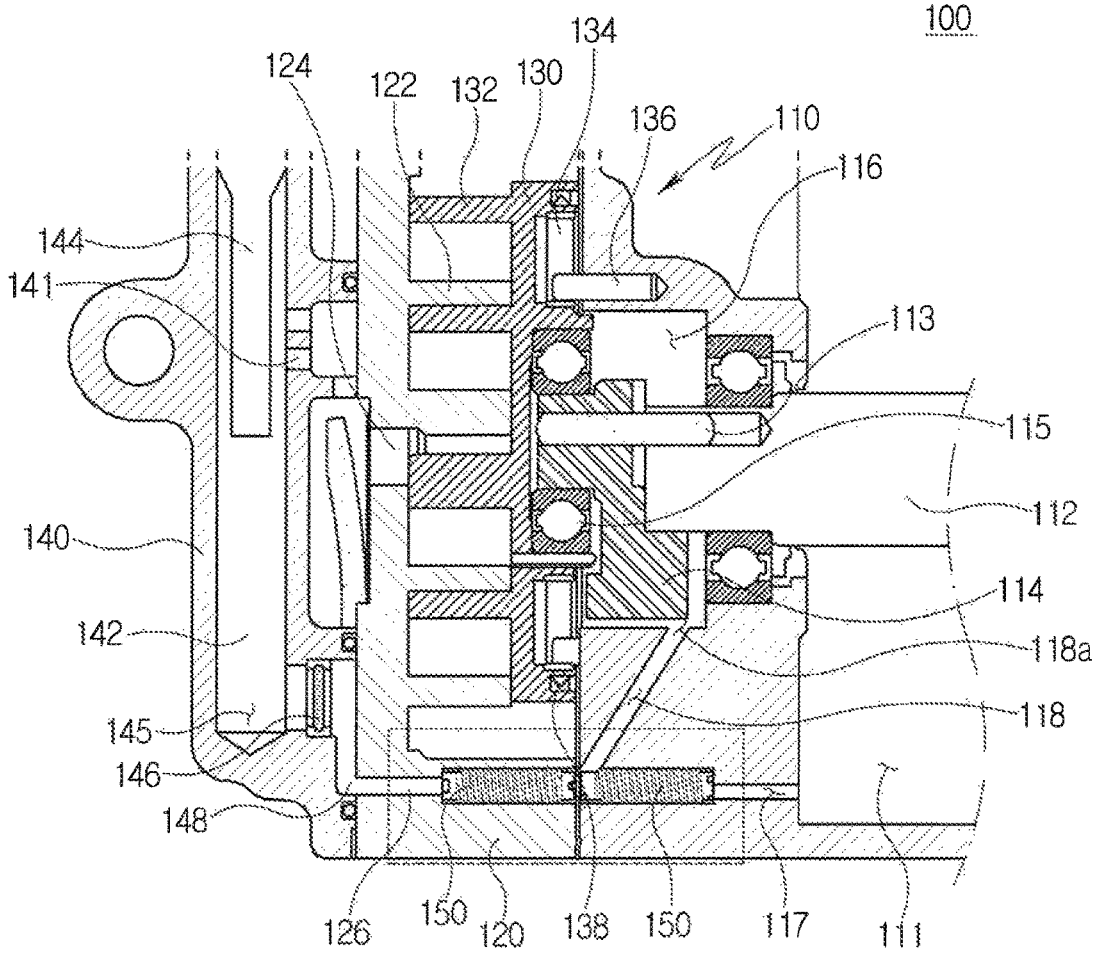
FIG. 1 is a sectional view illustrating an embodiment of a compressor in accordance with the present invention.

Referring to FIG. 1, there is illustrated a first embodiment of the compressor in accordance with the present invention. The first embodiment 100 includes a main housing 110 which has therein space in which a drive unit (not shown), for example, a motor, is housed. The main housing 110 generally has a cylindrical shape. The space in which the drive unit is housed functions as a suction space 111 in which refrigerant that is a target to be compressed temporarily remains before being drawn into a compression unit.

A rotating shaft 112 coupled with the above-mentioned drive unit is disposed in the suction space 111. A counter mass 114 is fixed to an end of the rotating shaft 112 by a fastening pin 113 inserted into the end of the rotating shaft 112. The counter mass 114 is provided to offset vibrations generated by eccentric rotation of a turning scroll, which will be described later herein. An end of the counter mass 114 is coupled with a rear surface of the turning scroll 130 through a bearing 115.

In this embodiment, a back pressure chamber 116 is formed in an end (a left end in FIG. 1) of the main housing 110. The back pressure chamber 116 is space formed to house the counter mass therein, and is formed such that an open end thereof is covered with the turning scroll 130. Therefore, the back pressure chamber 116 may be defined as space closed by the main housing and the turning scroll.

A first oil supply passage 117 is formed in a lower portion of the main housing 110. The first oil supply passage 117 is formed such that a first end thereof is exposed out of an end of the main housing and a second end thereof communicates with the suction space 111. In detail, the exposed end functions as an inlet 117*a* for refrigerant. The end of the first oil supply passage 117 that is located at a position corresponding to the suction space functions as an outlet 117*b*. Therefore, refrigerant drawn into the inlet can be discharged into the suction space through the first oil supply passage 117.

A second oil supply passage 118 diverges from the inlet 117*a*. The second oil supply passage 118 extends from the inlet 117*a* to the back pressure chamber 116 and has an outlet 118*a* that communicates with the back pressure chamber 116. That is, the first and second oil supply passages have the common inlet 117*a*, but the outlets thereof are respectively disposed at positions corresponding to the suction space and the back pressure chamber. Thus, drawn refrigerant is divided and supplied to the suction space and the back pressure chamber. A pressure reducing unit 150, which will be described later herein, is disposed in the first oil supply passage 117. The pressure reducing unit 150 is configured to reduce the pressure of refrigerant drawn into the inlet 117*a*, to the pressure in the suction space. An installation space 119, in which the pressure reducing unit 150 is disposed, is formed in the first oil supply passage 117.

The insert space 119 is formed such that it communicates with the first oil supply passage 117 and an inner diameter thereof is greater than that of the outlet 117*b*. Due to this, a stepped portion 119*a* is formed in a downstream end of the installation space 119. That is, the installation space 119 extends, at a first end thereof, to the end of the main housing 110 while a second end thereof communicates with the outlet 117*b*, such that the pressure reducing unit 150 can be inserted into the insert space 119 from the end of the main housing 110. In this regard, the stepped portion 119*a* functions not only as a stopper enabling the pressure reducing unit to be disposed at a correct position, but also to cause an additional pressure reduction due to a reduced diameter when refrigerant that has passed through the pressure reducing unit 150 enters the outlet 117*b*.

Figure 2:
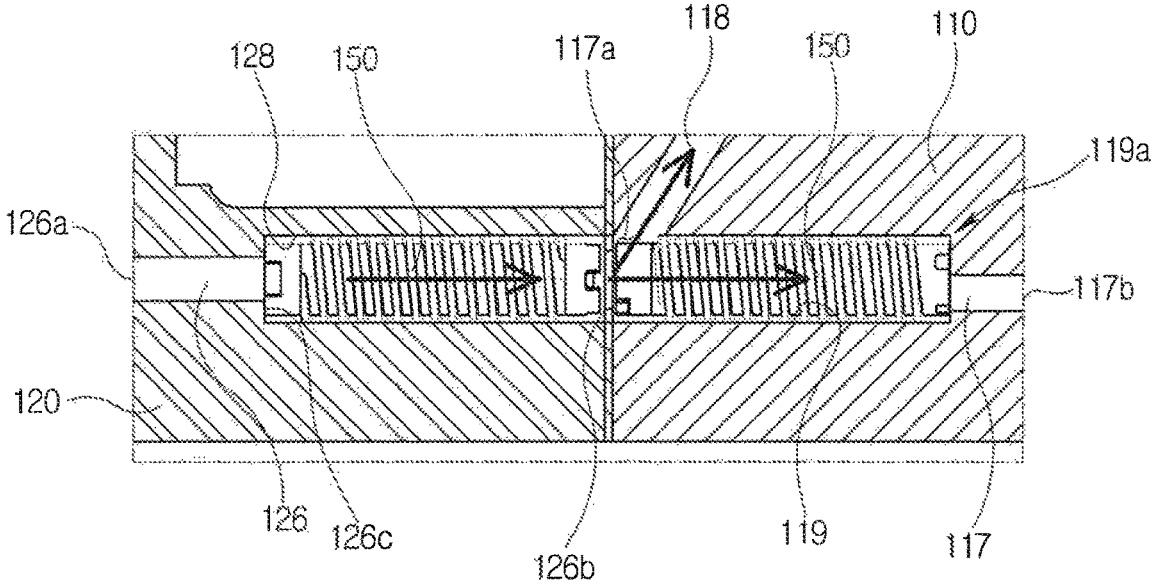
FIG. 2 is a sectional view showing an enlargement of a portion of FIG. 1.

A fixed scroll 120 is coupled to the left end of the main housing 110. The fixed scroll 120 includes a scroll 122 that engages with a scroll 132 of the turning scroll, and compression space is formed therebetween. An outlet 124 is formed in an approximately central portion of the fixed scroll 120 so that compressed refrigerant can be discharged out of the fixed scroll. An oil return passage 126, which communicates with the above-mentioned first oil supply passage 117, is formed in a lower portion of the fixed scroll 120. The oil return passage 126 extends between opposite ends of the fixed scroll. As shown in FIG. 2, an inlet 126*a* and an outlet 126*b* are respectively formed in the opposite ends of the fixed scroll. The outlet 126*b* communicates with the installation space 128 in which the pressure reducing unit 150 is disposed. As mentioned above, the installation space 128 is formed to provide space in which a pressure reducing unit 150 is installed. Due to this, a stepped portion 126*c* is formed at a position corresponding to the inlet 126*a* so that the pressure reducing unit can be disposed at the correct position.

The outlet 128*b* communicates with the inlet 117*a* of the first oil supply passage. The pressure reducing unit 50 is disposed in the oil return passage and reduces the pressure of oil to a pressure of a level greater than the pressure (hereinafter, a suction pressure) in the suction space. Therefore, the inlet 117*a* is applied with a pressure between a suction pressure and a discharge pressure, and this can be adjusted to correspond to a pressure required in the back pressure chamber.

A gasket 121 (refer to FIG. 3) is disposed between the fixed scroll 120 and the main housing 110 so as to prevent leakage of refrigerant. Communicating with the oil return passage and the first oil supply passage, a through hole 121*a* is formed in the gasket 121 so that returned oil can flow into the first oil supply passage. Although, as stated above, the gasket 121 has been illustrated as being provided to prevent leakage between the fixed scroll and the main housing, the gasket 121 having the through hole can also function to prevent leakage between the oil return passage and the first oil supply passage.

The turning scroll 130 is disposed between the fixed scroll 120 and the main housing 110. As described above, the turning scroll 130 is configured to perform turning motion relative to the main housing 110. However, to prevent the turning scroll 130 from rotating on its own axis, the turning scroll 130 is coupled by a rotation prevention depression 134 and a guide pin 136.

The turning scroll must come into close contact with the fixed scroll at an appropriate pressure. For this, the turning scroll is mounted so as to be movable relative to the rotating shaft in the axial direction. The degree with which the turning scroll compresses the fixed scroll can be adjusted depending on the pressure applied to the back pressure chamber. Various pressures ranging from the suction pressure to the discharge pressure are applied to a left side surface of the turning scroll. To keep the balance with the pressures, an intermediate pressure between the suction pressure and the discharge pressure is applied to the back pressure chamber. Furthermore, to maintain the pressure in the back pressure chamber in an appropriate level, a sealing unit 138 is disposed to enclose the back pressure chamber.

The pressure applied to the back pressure chamber is formed by supplying some of the refrigerant, while being compressed by the compressor, into the back pressure chamber. For this, a back pressure passage is formed to pass through opposite ends of the turning scroll. Opposite ends of the back pressure passage respectively communicate with a compression chamber and the back pressure chamber.

An auxiliary housing 140 is disposed on a left end of the fixed scroll 120. The auxiliary housing provides a discharge space 142 which communicates with the outlet 124 through an intermediate passage 141 so that compressed refrigerant can be drawn into the discharge space 142. The compressed refrigerant drawn in this way is discharged out of the compressor through a discharge port (not shown). Communicating with the discharge port, an oil separator 144 is disposed in the discharge space 142.

The oil separator 144 has a hollow tubular shape and is disposed such that only one end thereof communicates with the discharge port Therefore, compressed refrigerant drawn into the discharge space collides with the oil separator and the inner surface of the discharge space until it is discharged out of the compressor through the discharge port. During this process, oil that has been mixed with the compressed refrigerant is separated from the refrigerant and thus remains in the discharge space.

Oil separated in this way is collected by its own weight in a collection space 145 which is formed in a lower portion the discharge space 142. The collection space 145 communicates with the oil return passage 126 through a return flow passage 148. Thereby, separated oil can be drawn into the oil return passage. The oil drawn in this way is distributed into the back pressure chamber and the suction space depending on a difference in pressure caused by the pressure reducing unit. In this regard, the oil may be supplied after foreign substances have been filtered out while the oil passes through a filter 146.

Hereinbelow, the operation of the embodiment will be described.

Refrigerant that is drawn from the suction space into the compression chamber is compressed along with oil before being discharged out of the compressor via the discharge space 142. During this process, some of the oil mixed with the refrigerant is separated in the auxiliary housing and collected in the collection space 145, and then drawn into the oil return passage 126 via the filter 146. Subsequently, the oil is reduced in pressure to a level similar to the pressure in the back pressure chamber while passing through the pressure reducing unit 150, and then is drawn into the first and second oil supply passages.

Some of the drawn oil is supplied into the suction space through the first oil supply passage, and the rest is supplied into the back pressure chamber through the second oil supply passage. In this way, oil is reduced in pressure to the suction pressure by the pressure reducing unit provided in the first oil supply passage and then is resupplied into the suction space. Therefore, oil having a desired pressure can be supplied to a required space in the compressor in such a way that a plurality of passages are formed and some of the passages are provided with the pressure reducing units.

Furthermore, the compressor is configured such that oil is distributed from a single oil return passage, rather than having a configuration in which passages are individually formed. Therefore, the internal structure of the compressor can be simplified, and the stiffness of the housing can be enhanced.

In addition, the inlet of the second oil supply passage is disposed outside the sealing unit with respect to a radial direction and is formed to pass through the interior of the main housing. Therefore, unlike the case where the oil supply passage is formed along the sealing unit, oil can be more reliably supplied to the back pressure chamber. Furthermore, using the two pressure reducing units, the compressor is configured such that the inlet of the second oil supply passage is disposed at a point at which an intermediate pressure is applied. Therefore, even though the inlet of the second oil supply passage is disposed outside the sealing unit with respect to the radial direction, there is no possibility of leakage.

The pressure reducing unit may have an arbitrary shape. That is, the pressure reducing unit may be embodied by reducing a cross-sectional area of a portion of the oil return passage or the oil supply passage. Alternatively, as shown in the drawings, the pressure reducing unit may be embodied by a separate pressure reducing unit installed in the passage.

Figure 3:
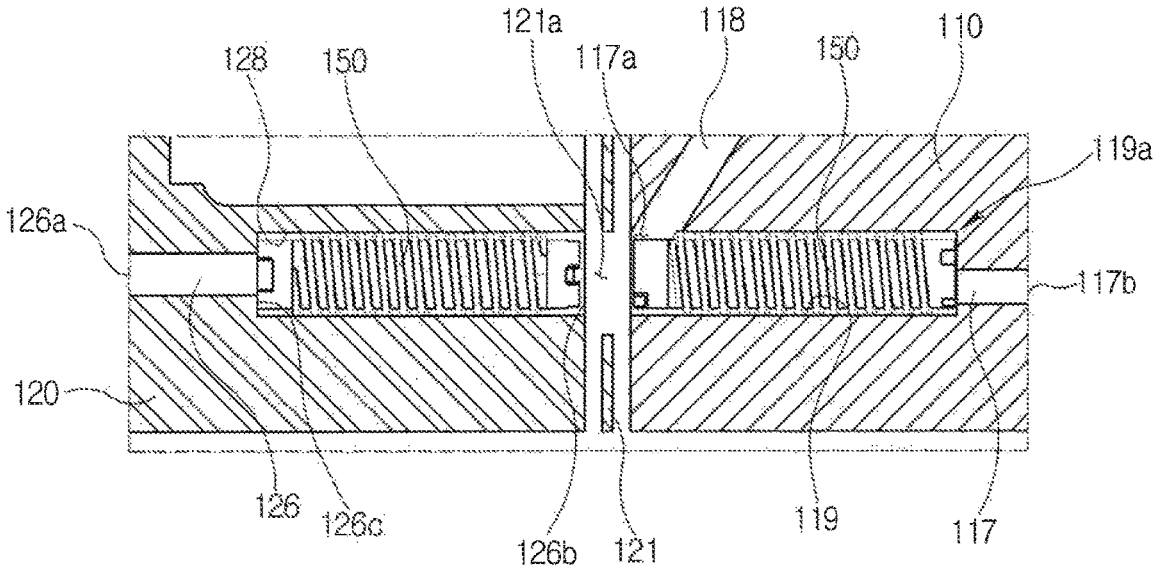
FIG. 3 is an exploded sectional view of the portion shown in FIG. 2.

FIGS. 2 and 3 illustrate an example of the pressure reducing unit. The pressure reducing unit 150 may be embodied by an oil transfer member having a cylindrical shape that extends in a longitudinal direction. The foregoing pressure reducing unit may be formed in the same manner as that of this pressure reducing unit. Hereinafter, for the sake of explanation, the pressure reducing unit will be called the oil transfer member. A spiral oil transfer groove 152 extending in a longitudinal direction is formed in an outer circumferential surface of the oil transfer member. The oil transfer groove 152, along with the inner surface of the first oil supply passage, provides a path along which oil is transferred.

Unlike the conventional art in which the inner surface of the passage through which oil passes is machined to have a predetermined shape and realize a reduction in pressure, the present invention is configured such that space for installation of the pressure reducing unit is formed and a pressure reducing unit which is separately manufactured is installed in the installation space. Therefore, in the present invention, the installation of the pressure reducing unit can be facilitated, and the process of manufacturing the compressor can be simplified.

The pressure reducing unit may be made of arbitrary material. For instance, the pressure reducing unit may be made of material having a stiffness lower than that of the material of a portion of the compressor in which the pressure reducing unit is disposed. In the present embodiment, the fixed scroll and the main housing may be made of cast iron or carbon steel. In this case, the pressure reducing unit may be made of material, e.g., resin or the like, having a stiffness lower than that of the fixed scroll or the main housing. As such, since the pressure reducing unit is formed to have a lower stiffness, the pressure reducing unit can be fixed, by force-fitting, in the installation space formed in the fixed scroll or the main housing.

Thereby, a separate fastening unit is not required, and a machining tolerance can be absorbed to some degree by deformation of the pressure reducing unit. Consequently, the manufacturing process can be simplified.

Figure 5:
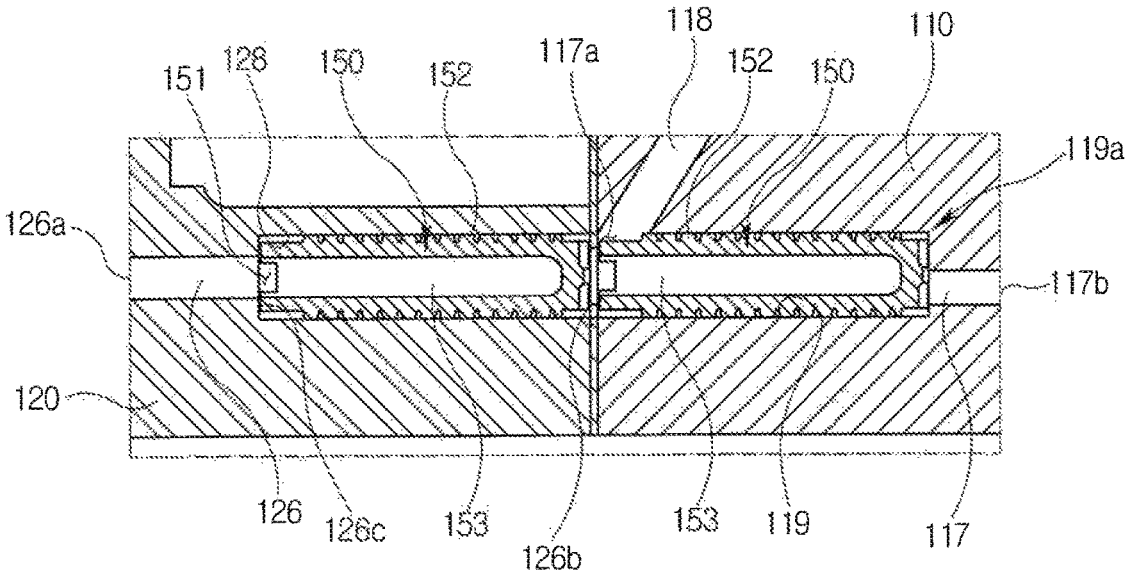
FIG. 5 is a sectional view showing an internal structure of the pressure reducing unit.

Referring to FIG. 5, the oil transfer member 150 has a hollow shape, and one end thereof forms an open end 151 so that an internal space 153 of the oil transfer member 151 communicates with the outside through the open end 151. The other end of the oil transfer member 150 that is opposite to the open end 151 forms a closed end. In this regard, the oil transfer member is disposed such that, of the opposite ends thereof, the open end 151 faces a relatively high-pressure side. For instance, in the case of the oil transfer member 150 that is disposed in the oil return passage, the open end 151 thereof is disposed toward the discharge space. In the case of the oil transfer member 150 that is disposed in the first oil supply passage, the open end 151 thereof is disposed to face the fixed scroll.

Therefore, some oil is drawn into the internal space 153, that is, a hydraulic space, through the open end 151. The oil drawn in this way compresses the oil transfer member outward with respect to the radial direction, in other words, toward the inner surface of the installation space 128. Thereby, the oil transfer groove 152 that is formed in the outer circumferential surface of the oil transfer member 150 is brought into close contact with the inner surface of the installation space so that oil is prevented from crossing over the oil transfer groove (in the direction from the left to the right in FIG. 5). Consequently, spiral movement of oil is promoted, and the distance of the flow path of the oil is increased, whereby the pressure reducing effect can be enhanced.

That is, after oil flowing through the first oil supply passage 117 reaches the oil transfer member 150, the oil moves along the oil transfer groove 152 and passes through the first oil supply passage 117. Because the oil transfer groove 152 is formed in the outer circumferential surface of the cylindrical oil transfer member 150 in the same shape as that of a screw thread, the distance that oil moves is increased compared to that of the case where oil linearly passes through the oil supply passage 117. Thereby, the pressure of oil can be further reduced. The oil that is reduced in pressure in this way is supplied to the suction space, thus lubricating the rotating shaft or the drive unit.

Figure 4:
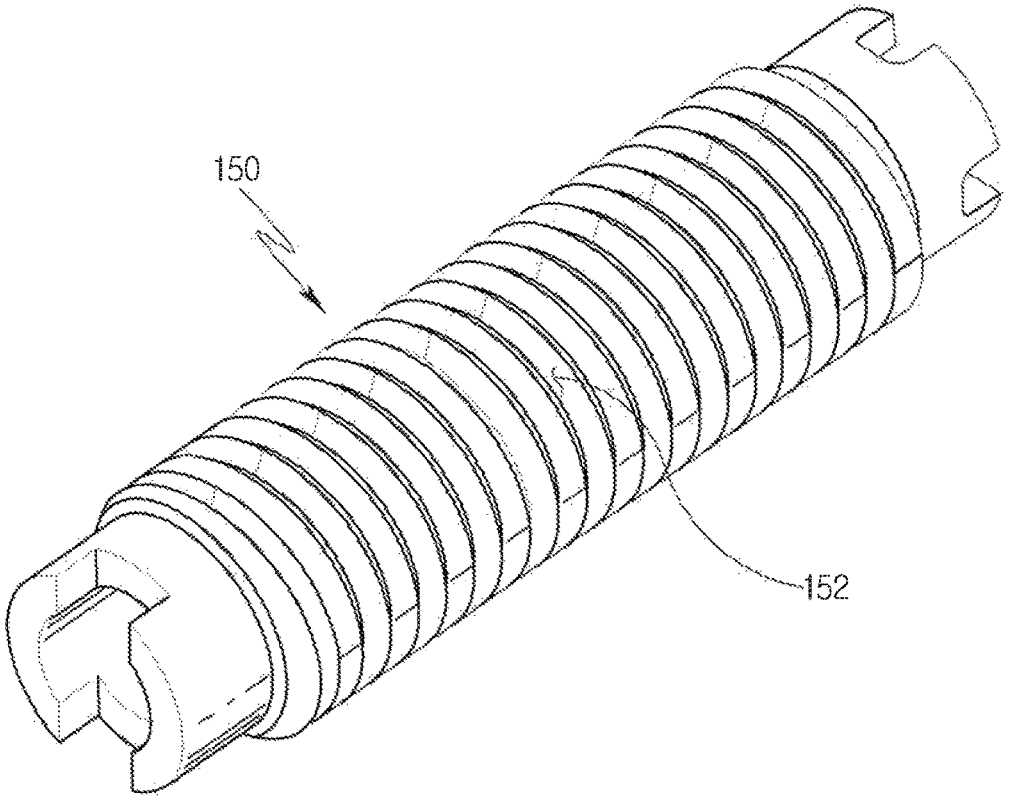
FIG. 4 is a perspective view illustrating a pressure reducing unit shown in FIG. 2.

Meanwhile, the pressure reducing unit may be embodied in the form shown in FIGS. 4 and 5. Referring to a modification example shown in FIGS. 4 and 5, a pressure reducing unit of this modification example includes a cover 154 which is fitted over the outer circumferential surface of the oil transfer member 150.

The cover 154 is formed to have a tubular shape and is fitted over the outer circumferential surface of the cylindrical oil transfer member 150. In this case, the oil transfer groove 152 formed in the outer circumferential surface of the oil transfer member 150 is covered with the cover 154. Therefore, during an assembly process, the oil transfer groove 152 can be protected from colliding with an inlet edge or inner surface of the oil return passage or the oil supply passage that is formed in the fixed scroll or the main housing.

The inner diameter of the cover 154 is formed to be the same as the outer diameter of the oil transfer member 150 so that the outer edge of the oil transfer groove 152 comes into close contact with the inner surface of the cover 154. Therefore, as shown in FIG. 5, the inner surface of the cover 154 and the oil transfer groove 152 form a passage through which oil is transferred. The outer diameter of the cover 154 is formed to be the same as the inner diameter of the oil supply passage. The cover 154 is thus fitted into the oil supply passage such that the cover 154 comes into close contact with the inner surface of the oil supply passage. The cover 154 may be made of rigid material having a high stiffness or, alternatively, it may be made of flexible material.

In the case where the cover 154 is made of rigid material, the tubular shape of the cover 154 is prevented from being deformed because of the high stiffness of the cover 154. Thus, the oil transfer member 150 can be easily fitted in a sliding manner into the cover 154, and the cover 154 can be easily fitted in a sliding manner into the oil supply passage 117 of the main housing 110. As shown in FIG. 5, the oil supply passage 117 is formed to be stepped so that an assembly of the oil transfer member 150 and the cover 154 can be fixed in place after the assembly has been fitted into the oil supply passage 117.

In the case where the cover 154 is made of flexible material such as rubber, because it has a relatively high elasticity, the cover 154 can not only be closely fitted over the outer circumferential surface of the oil transfer member 150 but can also be brought into close contact with the inner surface of the oil supply passage 117 of the housing and thus reliably fixed in the oil supply passage 117.

Figure 6:
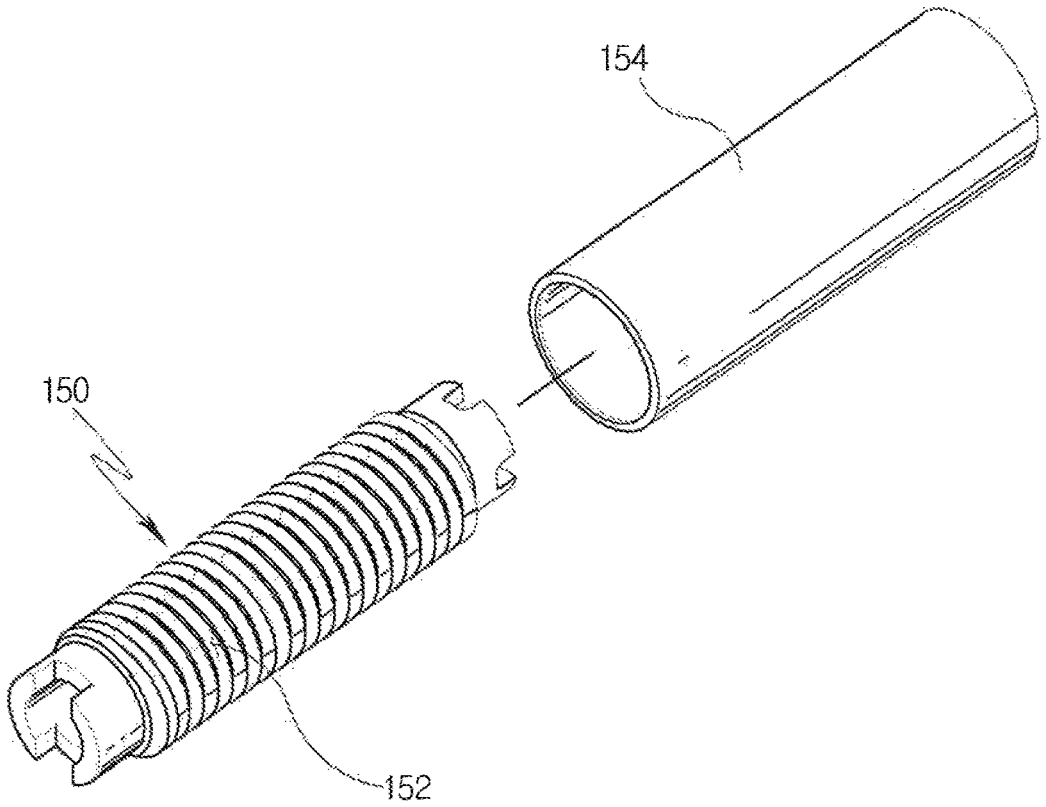
FIG. 6 is an exploded perspective view showing a modification example of the pressure reducing unit.
Figure 7:
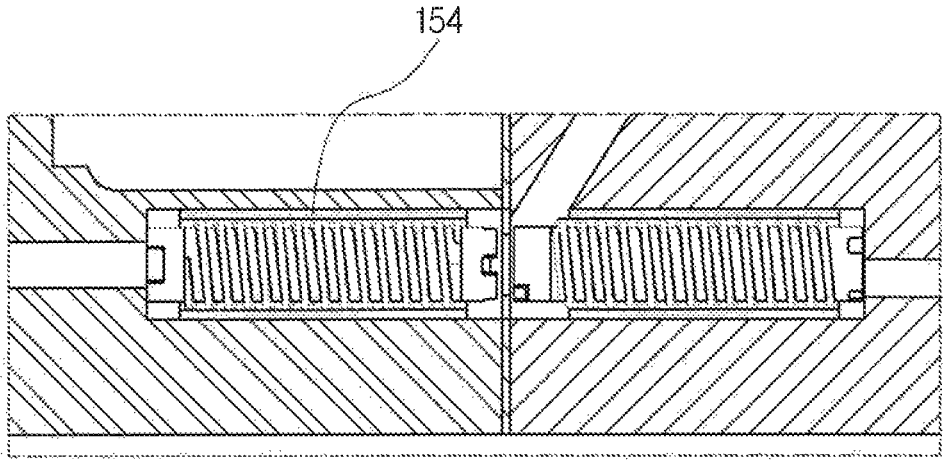
FIG. 7 is a view corresponding to FIG. 2, but showing application of the pressure reducing unit shown in FIG. 6.

The pressure reducing unit may be modified in the form shown in FIGS. 6 and 7. In this modification example, an oil transfer hole 162 extending in a longitudinal direction is formed in the oil transfer member 160.

The oil transfer member 160 has a cylindrical shape and is longitudinally inserted into the oil supply passage 117 of the main housing 110. The oil transfer hole 162 is spirally formed in the longitudinal direction in the oil transfer member 160. Therefore, oil passes through the oil transfer member 160 while spirally moving along the oil transfer hole 162. In this case, since the distance that oil moves is increased compared to the case where oil linearly passes through the oil supply passage 117, the pressure of oil can be reduced.

Unlike the modification example shown in FIGS. 4 and 5, in the present modification example, the oil transfer hole 162 is formed inside the oil transfer member 160 without being exposed to the outside. Therefore, during the assembly process, the oil transfer hole 162 can be prevented from colliding with the inlet edge or inner surface of the oil supply passage 117.

An oil guide groove 164 is formed in a front end of the oil transfer hole 162. The oil guide groove 164 is formed to be larger than a cross-sectional area of the oil transfer hole 162 so that oil can be easily collected into and guided by the oil transfer hole 162. The oil transfer member 160 of the present modification example has the oil transfer hole 162 therein and therefore is able to reliably protect, even without using the separate cover 154, the passage formed by the oil transfer hole 162 from being damaged and clogged during the assembly process.

Figure 8:
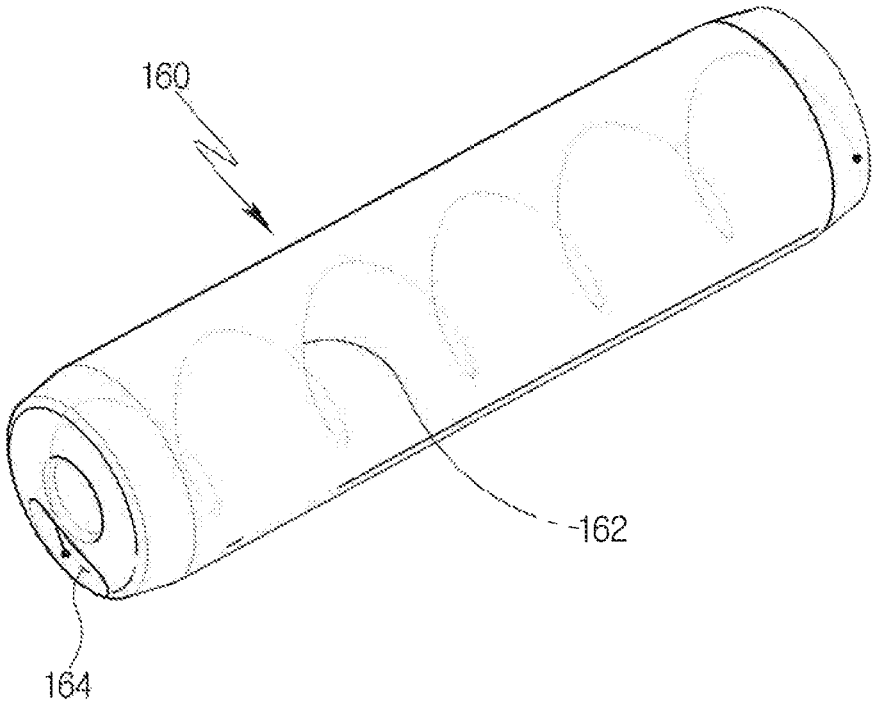
FIG. 8 is a perspective view showing another modification example of the pressure reducing unit.
Figure 9:
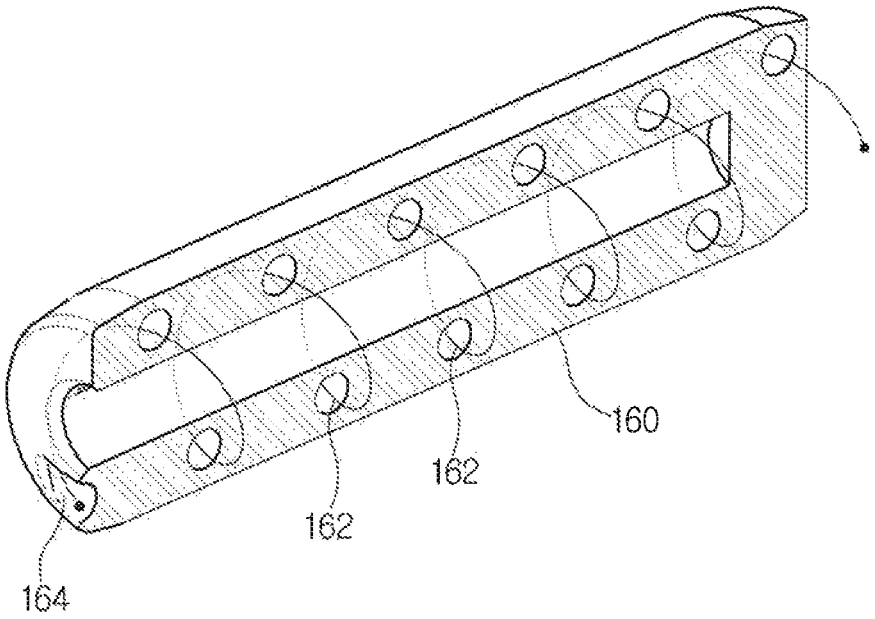
FIG. 9 is a perspective sectional view illustrating the pressure reducing unit shown in FIG. 8.
Figure 10:
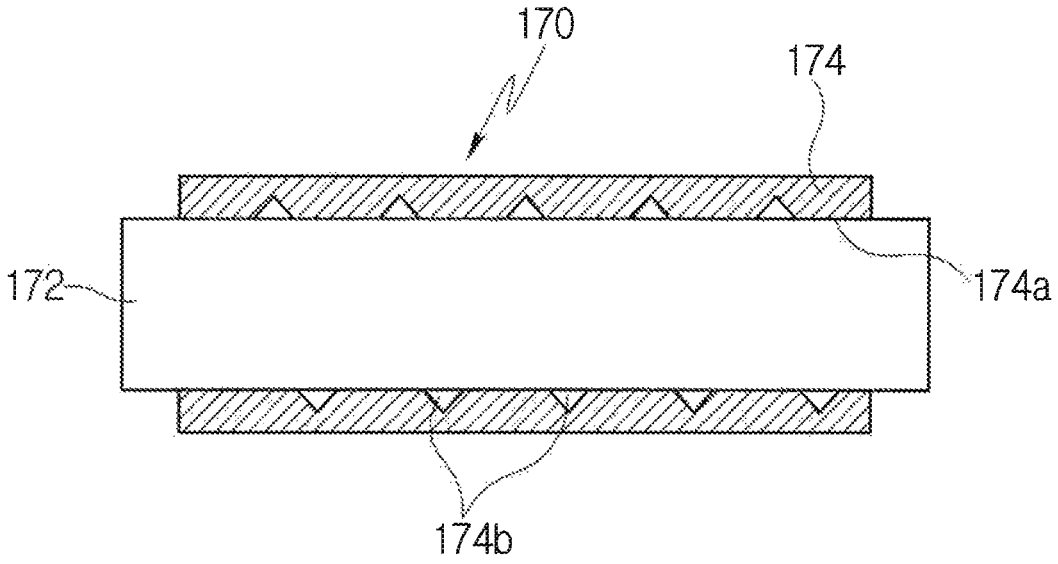
FIG. 10 is a perspective view showing yet another modification example of the pressure reducing unit.

The pressure reducing unit may be modified in the form shown in FIG. 8. Referring to FIG. 8, the pressure reducing unit 170 in accordance with the present modification example includes an oil transfer member 172, and a tubular cover 174, which is fitted over an outer circumferential surface of the oil transfer member 172 and has an oil transfer groove **174*b* formed in an inner surface 174*a* thereof. The oil transfer member 172 has a cylindrical shape and is longitudinally inserted into the oil supply passage 117 of the main housing 110**.

The oil transfer groove **174*b* is formed in the inner surface 174*a* of the cover 174 rather than being formed in the above-mentioned oil transfer member 150. The oil transfer member 172 has a smooth outer circumferential surface, and the oil transfer groove 174***b* having a screw thread shape is formed in the inner surface 174*a* of the cover 174. Therefore, the outer circumferential surface of the oil transfer member 172 and the oil transfer groove 174*b* of the cover 174 form an oil passage.

The oil transfer groove 174*b* of the cover 174 is spirally formed in the longitudinal direction of the cover 174. Therefore, oil passes through the oil transfer member 172 while spirally moving along the oil transfer hole 174*b*. In this case, since the distance that oil moves is increased compared to the case where oil linearly passes through the oil supply passage 117, the pressure of oil can be reduced.

The invention claimed is:

1. A compressor with an oil return unit, comprising:

a main housing;

a turning scroll turnably mounted to the main housing;

a fixed scroll engaging with the turning scroll and forming a compression chamber;

an auxiliary housing including a discharge space communicating with an outlet side of the fixed scroll, and a collection space in which oil collected in the discharge space is temporarily stored;

an oil return passage formed in the fixed scroll and communicating with the collection space; and an oil supply passage formed in the main housing and communicating with the oil return passage, the oil supply passage being formed to diverge such that an oil is supplied to at least two places, wherein the main housing has a suction space in which a rotating shaft and a motor are housed, and the oil supply passage includes a first oil supply passage communicating with the suction space, and wherein a pressure reducing unit is provided in the first oil supply passage.

2. The compressor according to claim 1, wherein a back pressure chamber is formed between a rear surface of the turning scroll and a facing surface of the main housing, and the oil supply passage includes a second oil supply passage communicating with the back pressure chamber.

3. The compressor according to claim 2, wherein a refrigerant pressure at an outlet side of the first oil supply passage is lower than a refrigerant pressure at an outlet side of the second oil supply passage.

4. The compressor according to claim 3, wherein an installation space is formed in the first oil supply passage so that the pressure reducing unit is disposed in the installation space, wherein an inner diameter of the installation space is greater than an inner diameter of an outlet of the first oil supply passage.

5. The compressor according to claim 2, wherein the first and second oil supply passages have a common inlet communicating with an outlet of the oil return passage.

6. The compressor according to claim 5, wherein a sealing unit for sealing the back pressure chamber is provided between the turning scroll and the main housing, and the common inlet is disposed outside the sealing unit with respect to a radial direction.

7. The compressor according to claim 1, wherein a pressure reducing unit is provided in the oil return passage.

8. The compressor according to claim 7, wherein an installation space is formed in the oil return passage so that the pressure reducing unit is disposed in the installation space, wherein an inner diameter of the installation space is greater than an inner diameter of an inlet of the oil return passage.

9. The compressor according to claim 8, wherein the pressure reducing unit includes an oil transfer member with an oil transfer groove formed in an outer circumferential surface of the oil transfer member, the oil transfer groove spirally extending in a longitudinal direction of the oil transfer member.

10. The compressor according to claim 9, wherein the oil transfer member has a hydraulic space therein with a communication hole formed in an end of the oil transfer member, the communication hole communicating with the hydraulic space.

11. The compressor according to claim 8, wherein the pressure reducing unit is formed of material having a stiffness lower than a stiffness of the fixed scroll or the main housing.

12. The compressor according to claim 1, wherein a sealing unit for preventing leakage of refrigerant between the fixed scroll and the main housing is interposed between the fixed scroll and the main housing, and a through hole for communicating the oil return passage and the first oil supply passage with each other is formed in the sealing unit.

13. A compressor with an oil return unit, comprising:

a main housing including a suction space in which a rotating shaft and a motor are is housed;

a turning scroll turnably mounted to the main housing;

a fixed scroll engaging with the turning scroll and forming a compression chamber;

an auxiliary housing including a discharge space communicating with an outlet side of the fixed scroll, and a collection space in which oil collected in the discharge space is temporarily stored;

a back pressure chamber formed in the main housing and applied with a pressure compressing the turning scroll to the fixed scroll;

an oil return passage formed in the fixed scroll and communicating with the collection space, with a pressure reducing unit provided in the oil return passage;

a first oil supply passage formed in the main housing and extending between the oil return passage and the suction space;

two pressure reducing units respectively provided in the oil return passage and the first oil supply passage; and a second oil supply passage diverging between the two pressure reducing units and communicating with the back pressure chamber.

14. The compressor according to claim 13, wherein the second oil supply passage includes an inlet formed in an end of the main housing.

15. The compressor according to claim 14, wherein a sealing unit for sealing the back pressure chamber is provided between the turning scroll and the main housing, and the inlet is disposed outside the sealing unit with respect to a radial direction.

16. The compressor according to claim 13, wherein an installation space is formed in at least one of the oil return passage and the first oil supply passage so that the pressure reducing unit is disposed in the installation space, wherein a stepped portion is formed on an end of the installation space.

17. The compressor according to claim 16, wherein the stepped portion blocks movement of the pressure reducing unit so that the pressure reducing unit is disposed at a correct position.

18. The compressor according to claim 13, wherein a sealing unit for preventing leakage of refrigerant between the fixed scroll and the main housing is interposed between the fixed scroll and the main housing, and a through hole is formed in the sealing unit so that the oil return passage and the first oil supply passage communicate with each other through the through hole.

* * * * *